United States Patent [19]

Navarre

[11] Patent Number: 4,557,313

[45] Date of Patent: Dec. 10, 1985

[54] CONTINUOUS SEQUENTIAL CASTING APPARATUS

[76] Inventor: Robert L. Navarre, 23800 W. Fairway Dr., Woodhaven, Mich. 48183

[21] Appl. No.: 122,600

[22] Filed: Feb. 19, 1980

Related U.S. Application Data

[63] Continuation of Ser. No. 918,717, Jun. 26, 1978, abandoned.

[51] Int. Cl.[4] ..... B22D 5/04; B22D 39/00; B22D 41/04

[52] U.S. Cl. ..... 164/155; 141/135; 164/136; 164/324; 164/329; 164/336; 164/337

[58] Field of Search ..... 164/322–326, 164/329, 155, 136, 336, 337; 266/236, 240; 141/144, 137, 135

[56] References Cited

U.S. PATENT DOCUMENTS

| | | | |
|---|---|---|---|
| 314,768 | 3/1885 | Whiting | 164/322 |
| 521,448 | 6/1894 | Adams | 164/322 |
| 596,897 | 1/1898 | May | 164/322 X |
| 682,512 | 9/1901 | Wellman et al. | 266/240 X |
| 1,340,422 | 5/1920 | Sheldon | 164/322 |
| 1,350,352 | 8/1920 | Anderson | 164/325 |
| 2,522,031 | 9/1950 | Gavin, Sr. | 164/324 X |
| 2,893,081 | 7/1959 | Gerster | 164/322 |
| 3,087,517 | 4/1963 | Magnuson et al. | 141/137 X |
| 3,187,394 | 6/1965 | Tama et al. | 164/326 X |
| 4,004,793 | 1/1977 | Gray | 164/322 X |

*Primary Examiner*—Nicholas P. Godici

*Assistant Examiner*—J. Reed Batten, Jr.

*Attorney, Agent, or Firm*—Alex Rhodes

[57] ABSTRACT

An apparatus for the continuous sequential casting of metals and their alloys wherein a furnace is rotated about an axis and a series of molds is continuously transported to the furnace and the molds are sequentially filled with molten metal poured from the furnace. Each of the molds is caused to move in synchronous arcuate motion with an outlet of the furnace directly above the mold, so that the mold may be filled with metal from the furnace during the synchronous motion thereof. Within the furnace, a central main chamber communicates with the respective chamber of each of the outlets, such that, a continuous circuit of molten metal is maintained between the main and outlet chambers. In the top portion of the main chamber, an annular opening allows the addition of charge to the furnace during the rotation thereof for the continuous sequential casting process. During the filling of the molds, metal is withdrawn from the furnace substantially below the slag therein to prevent slag from entering the molds. The discharge of metal from an outlet is controlled automatically by a power operated stopper rod, opening and closing an outlet orifice, positioned such that either the rod or orifice may be easily replaced to reduce service cost and reduce production losses. The support structure of the furnace is pivotable about a horizontal axis so that the furnace may be back-tilted to stop leakage from an outlet, service a stopper rod or orifice and assist in the removal of slag.

10 Claims, 9 Drawing Figures

CONTINUOUS SEQUENTIAL CASTING APPARATUS

This is a continuation of application Ser. No. 918,717 filed June 26, 1978 and now abandoned.

BACKGROUND OF THE INVENTION

The present invention is directed primarily to the casting of iron and steel and their alloys but may be used for the casting of non-ferrous metals and alloys. At the present time the greatest tonnage of cast iron is produced from the cupola furnace. The cupola furnace is a continuous melting medium wherein charges of graded pig iron and selected scrap are interspersed with layers of coke so that the fuel bed may be replenished as the iron is melted. Molten iron is drawn from the cupola and generally transported to stationary molds wherein the iron is cast. In lesser quantities, iron and steel castings are produced from the open-hearth, electric arc, converter, electric induction and crucible furnaces.

Although furnace designs depend upon the efficiency of heat transfer to the charge, thermal efficiency is not the principal factor in furnace selection since the overall economy in the casting of metals depends also upon capital investment, production quantities, labor costs, fuel costs and casting quality requirements. In addition, the control of industrial pollution has become an important consideration and in some cases the most important with regard to furnace selection.

Various types of apparatus have been offered for the continuous casting of metals and their alloys. In the case of iron and steel foundries, existing equipment for continuous casting has disadvantages, such as, the requirement for a large amount of floor space, excessive repair and, the high amount of support labor. In addition, in some cases production quantities have not been achieved with existing equipment or product quality has been unacceptable with resulting high quantities of scrappage.

Clearly, a continuous sequential casting apparatus of compact construction, capable of high production volumes of quality castings, would be of significant benefit. It is an object of the present invention to produce high quality castings at high production volumes. It is another object to provide an apparatus which is compact in size so as not to require a large amount of floor space. It is still another object to reduce the labor requirements for casting metals and their alloys. It is again another object to provide a continuous casting apparatus whereby metal is poured directly from a furnace into molds so that the temperature of the metal may be better controlled to improve product quality and reduce part scrappage. It is still yet another object to provide in a continuous sequential casting apparatus a significant reduction in repair time and cost by making stopper rods and outlet orifices more easily accessible for repair or replacement.

The foregoing objects, along with additional objects, features advantages, and benefits of the invention, become more apparent in the ensuing description and accompanying drawings which disclose the invention in detail. A preferred embodiment is disclosed in accordance with the best mode presently contemplated in carrying out the invention. The subject matter in which an exclusive property is claimed is set forth in each of the numbered claims at the conclusion of the description, and such subject matter is considered patentable over the prior art of which the applicant is aware, as set forth in the following Prior Art Statement.

PRIOR ART STATEMENT

A novelty search performed in connection with the present invention developed the following patents: U.S. Pat. Nos. 314,768; 521,448; 596,897; 1,340,422; 1,350,352 and 2,893,081.

U.S. Pat. No. 314,768 discloses a series of molds which are arranged in rows with overhead cranes in line with the molds. Molten metal is first poured from a cupola into ladles which are transported on a track by a chain or cable to the overhead cranes for filling the molds.

U.S. Pat. No. 521,448 discloses a series of stationary molds in a line with an interconnecting runner above the mold cavities and a ladle positioned above the said runner. During the filling of the molds, the ladle and molds are stationary.

U.S. Pat. No. 596,897 discloses a series of stationary molds arranged in a circle with an overhead ladle centrally positioned above the molds. A rotating runner is positioned with one end under the ladle and the other end above the molds whereby metal is transferred to the molds by the rotating runner.

U.S. Pat. No. 1,340,422 discloses an apparatus wherein pairs of molds are transported on mold cars to a cupola. A novel construction of a trough under the spout of the cupola allows simultaneous filling of a pair of molds.

U.S. Pat. No. 1,350,352 discloses a casting machine wherein a series of molds are permanently arranged in a circle and revolve about a horizontal axis. The half sections of each of the molds are hinged to the frame of the machine whereby the uppermost mold may be filled and a finished casting ejected from the lowermost mold in the machine.

U.S. Pat. No. 2,893,081 discloses a machine for casting light metal ingots and alloys wherein stationary molds are arranged in a circle. Metal is transferred from an oscillating runner to each of the molds. After the ingots have solidified they are ejected from the molds by power actuated ejection rods.

This Prior Art Statement is furnished in compliance with applicant's duty of disclosure as defined in the Patent and Trademark Office Rules for patent cases.

DESCRIPTION OF THE PREFERRED EMBODIMENT

Figure 1:
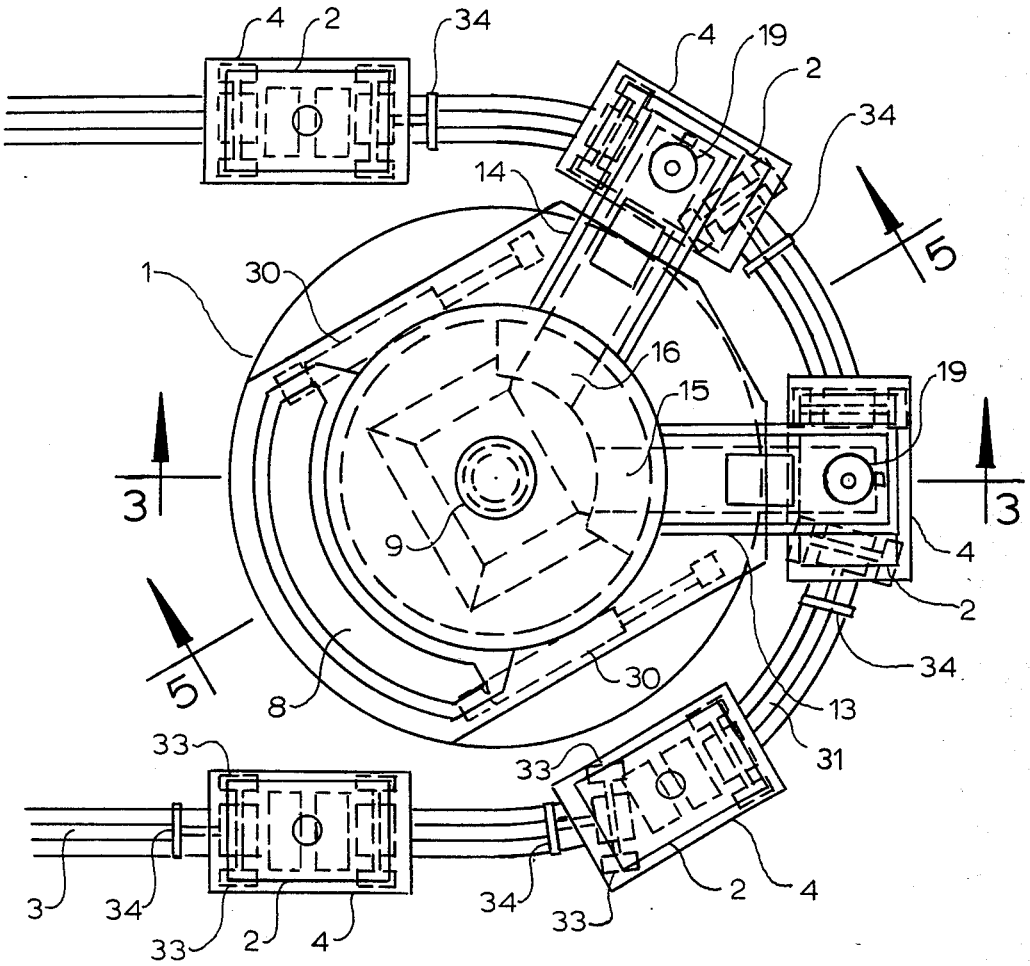
FIG. 1 is a plan view of the preferred embodiment of the present invention drawn to a reduced scale from the actual apparatus showing a series of mold carts with their respective molds positioned in a circular arrangement relative to a casting furnace.
Figure 2:
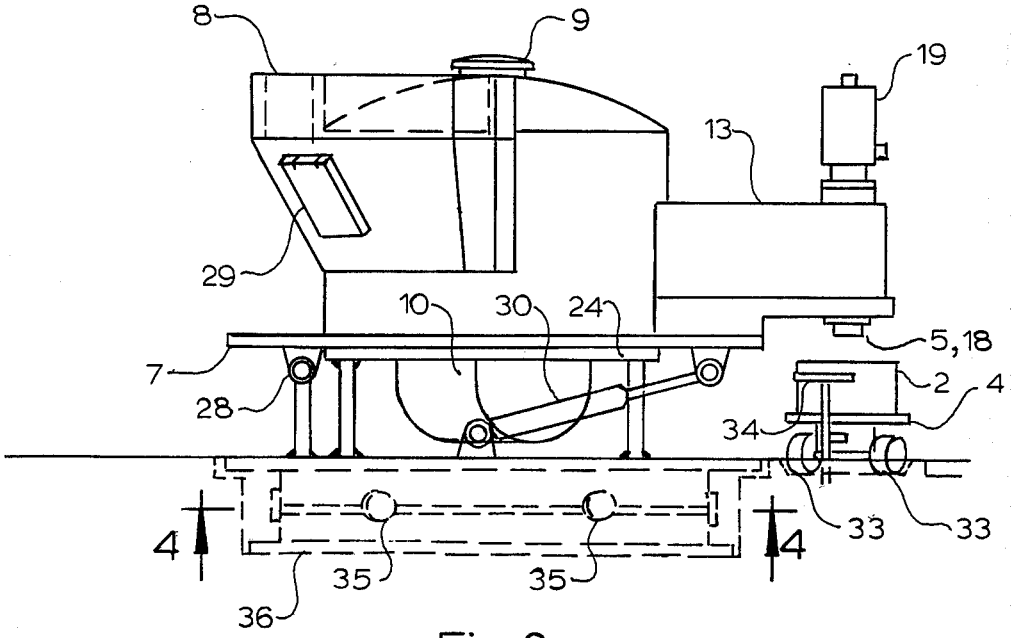
FIG. 2 is a side elevation view of the embodiment shown in FIG. 1. For clarity, a single mold cart and mold opposite a pouring spout of the furnace is shown.

With reference to the accompanying drawings, the preferred embodiment of the present invention comprises a dual outlet furnace 1 in combination with a series of molds 2 and a means for transporting molds 2, to and away from furnace 1. Furnace 1 is mounted for rotation about a vertical axis and rotates back and forth about the axis as a floor conveyor 3 advances the molds 2, on their respective carts 4, to furnace 1. An automatic control system, which is auxiliary to the present invention, controls the operation of furnace 1, whereby when a pair of molds 2 are advanced to a position where they are directly under a pair of outlets 5 and 6 of furnace 1, outlets 5 and 6 are opened and the molds are filled with metal from furnace 1.

During filling of molds 2, molds 2 and outlets 5 and 6 move with the same motion. After filling has been completed, outlets 5 and 6 close and the rotation of furnace 1 is reversed and accelerated, to return furnace 1 to its initial position with outlets 5 and 6 directly above a second pair of molds 2. The rotation of furnace 1 is again reversed and outlets 5 and 6 opened to begin a new filling cycle for the second pair of molds 2. The process of filling and transporting molds 2 to and from furnace 1 is repeated continuously, whereby large numbers of castings are produced at reduced costs over current casting processes.

Figure 3:
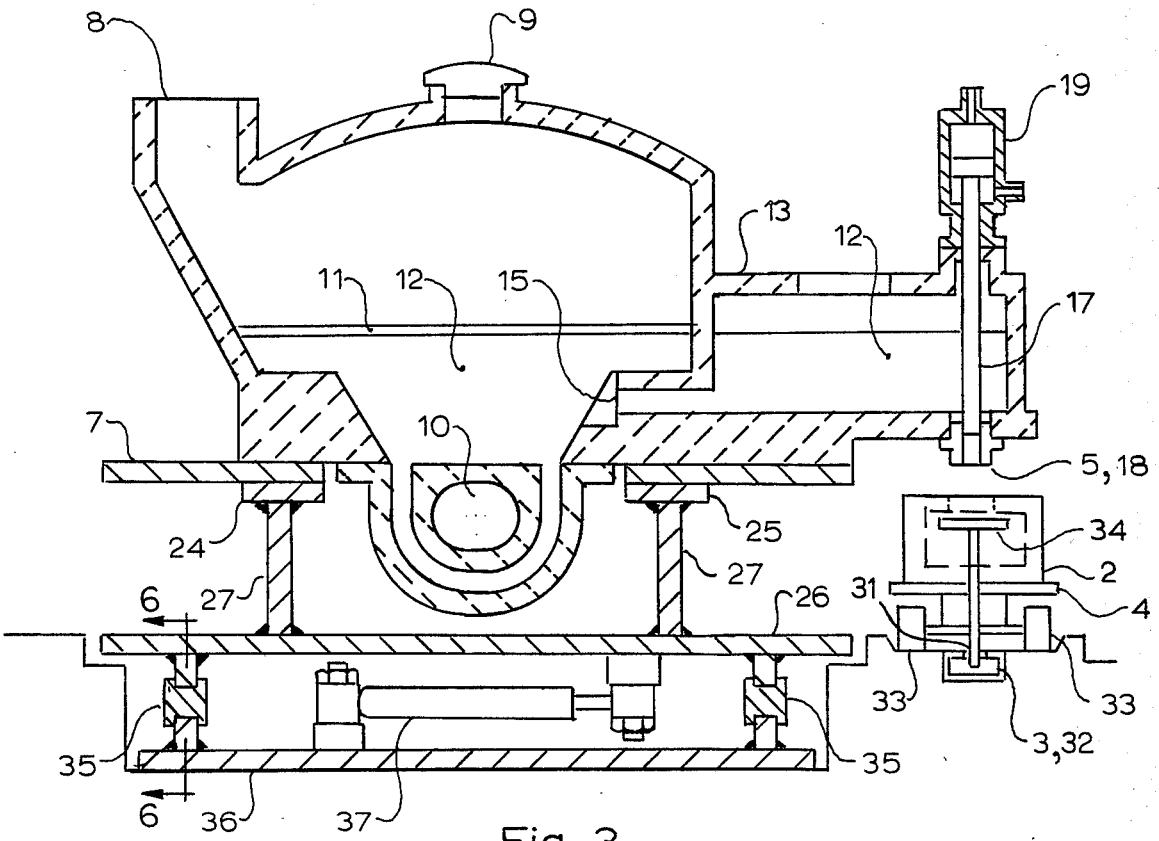
FIG. 3 is a cross-sectional view in the direction of arrows 3—3 of FIG. 1 wherein is shown to a scale enlarged from FIG. 1 the internal construction of the furnace and the end view of a mold cart directly below an outlet of the furnace.
Figure 4:
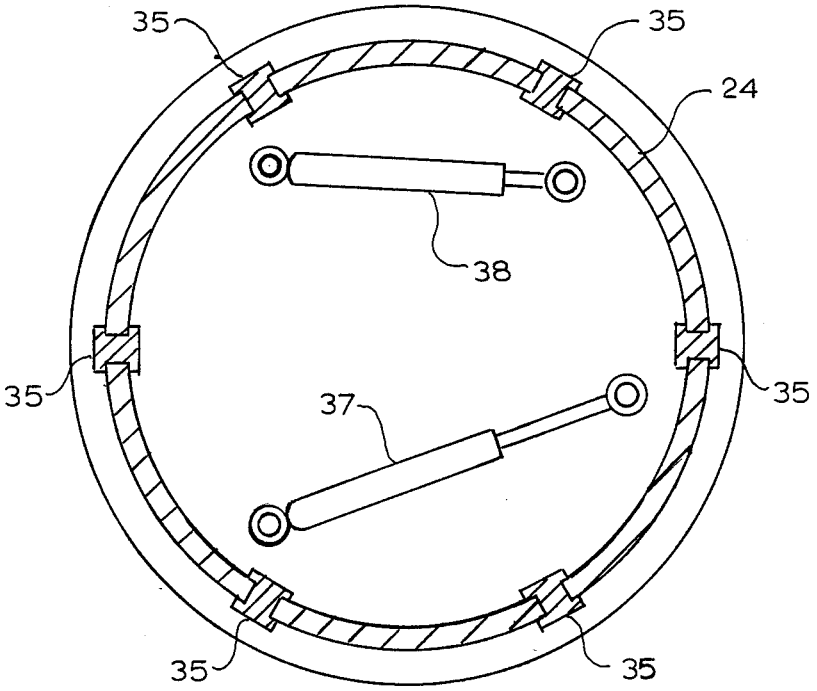
FIG. 4 is a cross-sectional view in the direction of arrows 4—4 of FIG. 2 drawn to an enlarged scale from FIG. 2 showing a pair of telescopic cylinders and an arrangement of rollers for rotating the furnace.

Specific features of furnace 1 which is believed to be novel, are shown in FIG. 3 wherein a generally cylindrical structure, constructed mostly of refractory materials is mounted on a base plate 7. In the top portion of furnace 1 is an annular opening 8 for admitting a charge to furnace 1 and a cover 9 for inspecting the contents of furnace 1. It is apparent that the annular shape of opening 8 provides a benefit for adding a charge during the back and forth rotation of furnace 1.

At the base of furnace 1 is an electric induction unit 10 which supplies heat for maintaining the charge in a molten condition. The separate beds of slag and metal which comprise the charge inside of the main body of furnace 1 are designated in the drawings by the numerals 11 and 12, respectively.

Projecting outwardly from the main body of furnace 1 are a pair of outlet chambers 13 and 14 through which the metallic portion of the charge flows during the filling cycles of molds 2. Outlet chambers 13 and 14 also provide additional volume in the event excess charge is added to furnace 1 and prevent slag from being discharged into the molds 2. The metallic portion of the charge enters outlet chambers 13 and 14 through openings 15 and 16 which are positioned substantially within the metallic bed 12 in the main body of furnace 1. It is obvious that the position of openings 15 and 16 confines the slag to the main body of furnace 1.

Figure 7:
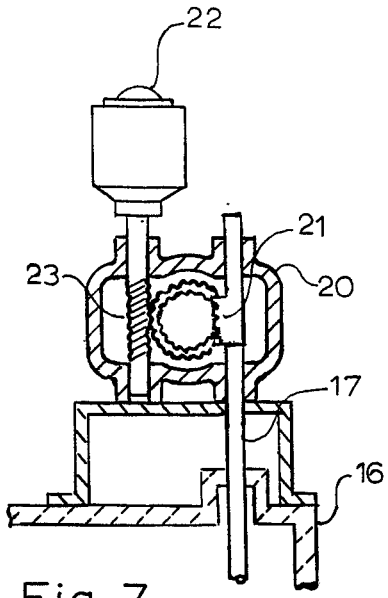
FIG. 7 is a partial cross-sectional view taken in the same direction as FIG. 3 showing an alternate means for movement of a stopper rod.
Figure 6:
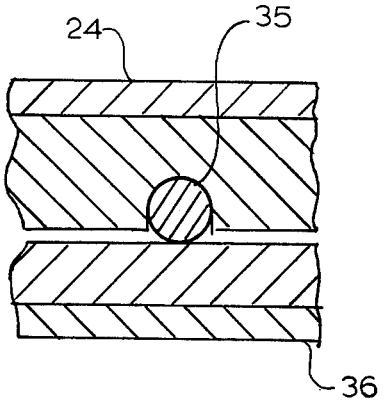
FIG. 6 is a partial cross-sectional view taken in the direction of arrows 6—6 of FIG. 3 drawn to an enlarged scale from FIG. 3.

Withdrawal of metal from outlets 5 and 6 is controlled by raising and lowering a stopper rod 17 in an orifice 18 at each of the outlets 5 and 6. A double acting power cylinder 19 raises and lowers each of the stopper rods 17. Cylinder 19 may be either pneumatically or hydraulically actuated. In FIG. 7 an optional drive 20 is shown for raising and lowering a stopper rod 17 of the present invention. The optional electro-mechanical drive comprises a rack 21 affixed to one end of the stopper rod 17 and coupled to an electric motor 22 by a worm type speed reducer 23.

From the description of outlets 5 and 6 and reference to the drawings, it is obvious that the design and placement of outlets 5 and 6 provide advantages over existing systems. The direct feed of metal from the furnace 1 into molds 2, rather than from an intermediate vessel such as a ladle, results in improved temperature control during pouring with a resulting improvement in casting quality. Also, the reduction in the amount of equipment required for pouring, e.g., ladles and cranes, reduces the amount of production losses, fixed investment, and plant space. Of further benefit is the improvement in serviceability of a stopper rod 17 and outlet orifice 18. The service and replacement of a stopper rod or outlet orifice is a major problem with many current casting systems which accounts for a considerable portion of the production losses. The accessibility of a stopper rod 17 and outlet orifice 18 in the present invention reduces service time and production losses.

Figure 5:
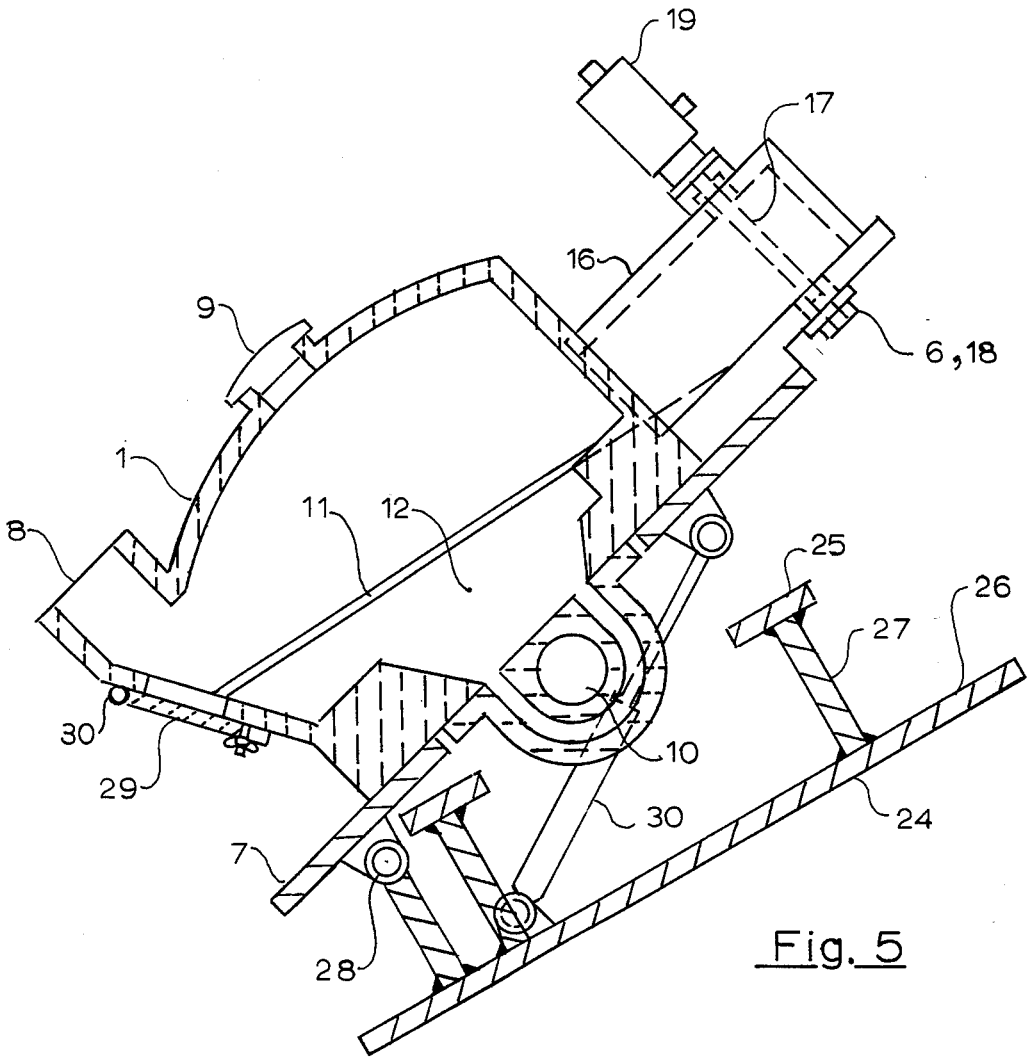
FIG. 5 is a cross-sectional view in the direction of arrows 5—5 of FIG. 1 drawn to an enlarged scale from FIG. 1 showing the furnace in a tilted position.

Directly below base plate 7 is a platform structure 24 upon which the base plate 7 rests. The platform structure 24 comprises an upper 25 and lower 26 plate which are spaced apart by vertical supports 27. Furnace 1 is rotatable about a horizontal axis at a journal connection 28 whereby furnace 1 may be back-tilted for slag removal or service of a stopper rod 17 or outlet orifice 18. Back-tilting also permits a furnace operator to check the flow of metal from a leaky outlet. The benefits of back-tilting are illustrated in FIG. 5 wherein furnace 1 is shown in a back-tilted position. It is apparent in FIG. 5 that back-tilting removes the charge from the furnace outlet 5, thereby making the stopper rod 17 and outlet orifice 18 accessible for servicing. It is further apparent that in the back-tilted position there will be no leakage from outlet 6. The means for removing slag is also illustrated in FIG. 5. A slag door 29 is provided which is pivotally attached to furnace 1 by a hinge 42 at the upper portion of the door 29. Slag is removed by back-tilting furnace 1 with door 29 in an open position. Power cylinders 30 back-tilt furnace 1.

The means for transporting mold carts 4 to and from furnace 1 is shown in FIG. 3. Directly beneath the floor opening 31 is the chain type conveyor 3 wherein a series of pusher-dogs 32 are provided at spaced intervals along the chain. Mold cart 4 includes steerable front wheels 33 and a vertical post 34 which extends through floor opening 31 and engages the pusher-dog 32 which provides the motive power for mold cart 4.

Figure 8:
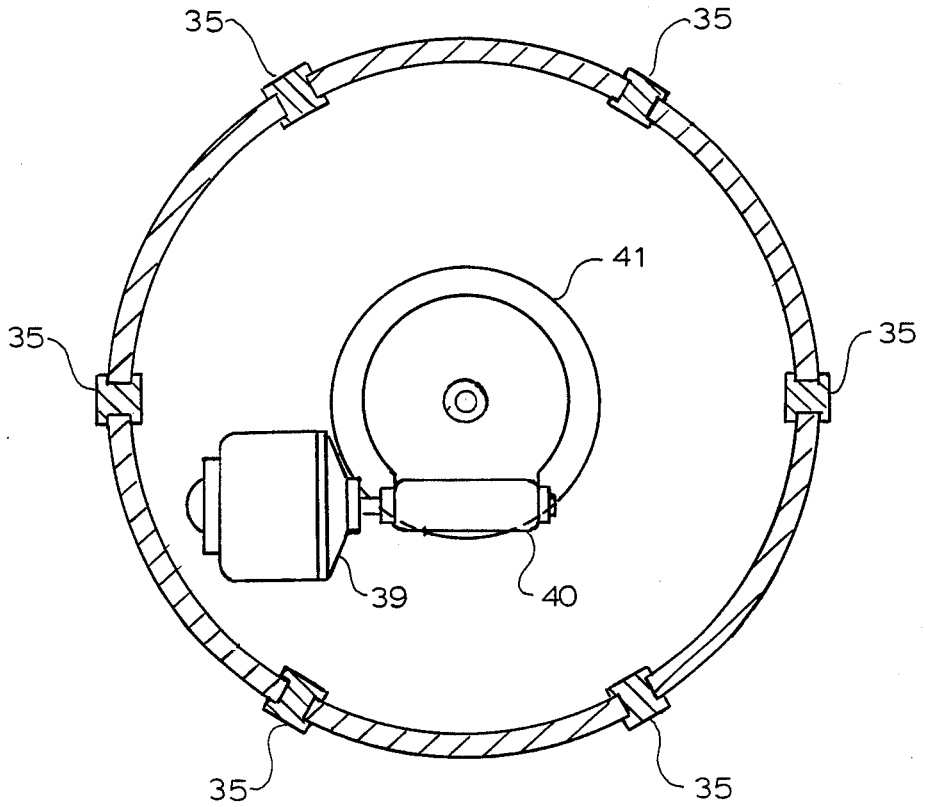
FIG. 8 is a cross-sectional view taken in the same direction as FIG. 4 showing an alternate means for rotating the furnace.
Figure 9:
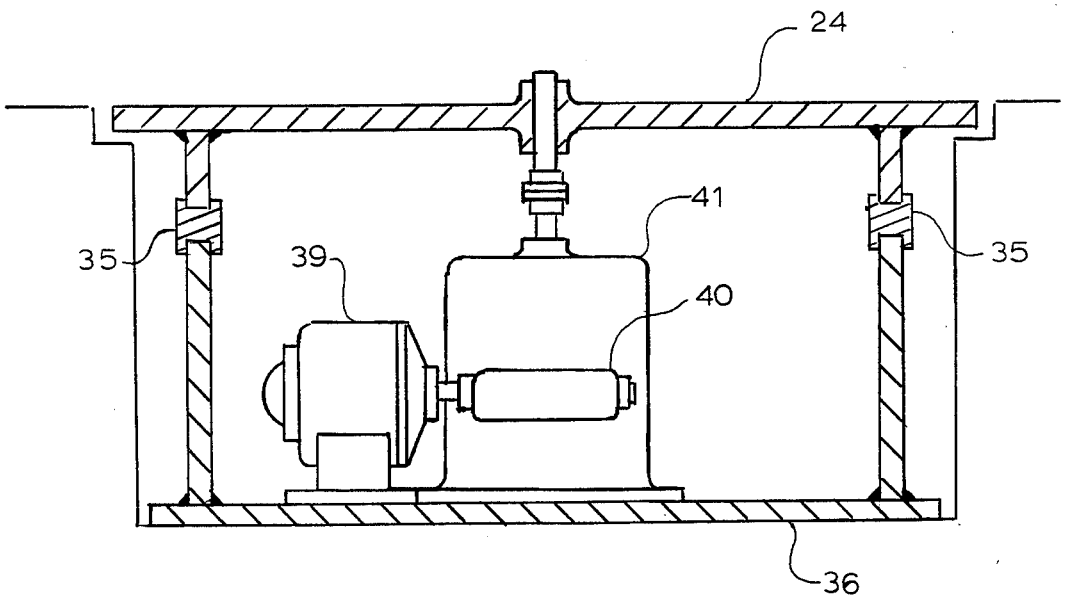
FIG. 9 is a partial cross-sectional view taken in the same direction as FIG. 3 showing the side elevation of the alternate means for rotating the furnace.

The platform structure 24 is supported on a series of rollers 35 which bear upon a foundation structure 36. Rollers 35 allow rotation of the platform structure 24 and furnace 1 about the vertical axis when the platform structure 24 is acted upon by a pair of hydraulic or pneumatic cylinders 37 and 38. In FIGS. 8 and 9 are shown an alternate means for rotating furnace 1 wherein an electric motor 39 is coupled to the platform structure 24 by a speed reducer 40 and gear drive unit 41.

In summary, the present invention provides a new and unique continuous sequential casting apparatus which offers advantages and benefits. It is apparent from the accompanying figures and specifications that what has been achieved is a continuous casting apparatus which is compact in size relative to many existing units and provides economy of operation by reducing labor requirements and increasing production volumes. It is further apparent that other features, such as, the back-tilting of the furnace for slag removal or outlet service and the ability to charge the furnace during rotation thereof provide additional benefits.

While a preferred embodiment of the present invention has been shown, it will be appreciated that other embodiments drawing from individual features of the shown embodiment can be provided. For example, a similar apparatus can be constructed using the alternate electro-mechanical means, shown in FIGS. 8 and 9, for rotating furnace 1, whereby after a pair of molds 2 have been filled, furnace 1 can be returned to its initial position by accelerating the rotation of furnace 1 in the same direction rather than reversing the rotation of furnace 1. Also, rather than a pair of outlet chambers 5 and 6, a single outlet chamber or greater number of outlet chambers may be used in the present invention.

What I claim is new is:

1. An apparatus for the continuous sequential casting of metals wherein a mold is advanced to a position directly under an outlet of a rotating furnace and then synchronized to move in arcuate motion with the outlet during the filling of the mold comprising: a furnace mounted for rotation about a vertical axis and having at least one outlet for discharging metal therefrom, said outlet moving in an arcuate path during the discharge of metal therefrom and a closure means for opening and closing said outlet; an underlying platform structure for supporting the furnace, said structure having a pair of plates spaced apart by vertical members and journal connected to the furnace at a location opposite the discharge outlet whereby said structure rotates in unison with the furnace during the discharge therefrom and said journal connection provides a horizontal axis opposite said outlet for back-tilting said furnace to prevent leakage from a defective outlet or allow service thereof, a foundation structure underlying said platform structure upon which the furnace and platform structure are mounted for rotation about said vertical axis and a bearing means interposed between said platform and foundation structures; a means for rotating the furnace about said vertical axis; a means for back-tilting said furnace about said horizontal axis; a series of molds for receiving metal from said furnace; a means for transporting said molds consecutively to and from said furnace, such that, when a mold is advanced to a position directly under said outlet, said mold moves in an arcuate path directly under said outlet; and a means for controlling the operation of said furnace whereby the motion and discharge of the outlet are synchronized with the motion of the mold.

2. An apparatus for the continuous sequential casting of metals wherein a mold is advanced to a position directly under an outlet of a rotating furnace and then synchronized to move in arcuate motion with the outlet during the filling of the mold comprising: a furnace mounted for rotation about a vertical axis during the filling of a mold and for back-tilting about a horizontal axis for stopping leakage from a defective outlet or the service thereof comprising a cylindrical chamber centered about said vertical axis for receiving and holding a metallic type charge, at least one outlet chamber extending outwardly from said central chamber for admitting a metallic portion of the charge from the central chamber and confining the slag portion of the charge to said central chamber, a means for maintaining the charge within said furnace and outlet chamber in a molten condition, an outlet at the end portion of said outlet chamber farthest from said central chamber in continuous contact with said molten charge whereby said outlet is prevented from being clogged by solidified charge and when said furnace is in a back-tilted position said outlet may be easily serviced or leakage from said outlet may be checked and a means for opening and closing said outlet and an annular shaped opening in the outer top portion of the central chamber whereby the annular shape of the opening allows charge to be added during the rotation of the furnace in said continuous casting of metals; a platform structure for supporting said furnace, said structure rotating in unison with the furnace during the filling of a mold and remaining stationary when said furnace is back-tilted about a journal connection to said structure at the side of said furnace opposite said outlet chamber; a stationary foundation structure for supporting said furnace and platform structure; a bearing means interposed between said platform and foundation structures whereby said furnace and platform structure may be rotated in unison about a vertical axis; a series of molds for receiving the discharge directly from said furnace outlet; a conveyor means for transporting the molds consecutively to and from said furnace wherein said molds are carried on mold carts and said mold carts are towed by a floor conveyor, such that, when a mold is advanced to a position directly under a furnace outlet, said mold under the outlet moves in an arcuate path and in synchronous motion with the outlet during the discharge of metal therefrom; and a means for controlling the operation of said furnace whereby the motion and discharge from the outlet are synchronized with the motion of the mold.

3. An apparatus for the continuous sequential casting of metals comprising: a foundation structure; a bearing means mounted on the foundation structure; a platform structure supportably mounted on the bearing means, for rotation about a vertical axis passing through the foundation structure; a first driving means mounted to the foundation structure and connected to the platform structure for rotating the platform structure about said vertical axis; a journal means attached to one end portion of the platform structure with the axis of the journal means beng horizontally disposed; a base plate supportably mounted on the platform structure and connected at an end portion thereof to the journal means; a second driving means mounted to the platform structure and connected to the base plate about said horizontal axis; a furnace supportably mounted on the base plate for rotation about said vertical and horizontal axes; and a means for receiving molten metal poured from said furnace.

4. An apparatus for the continuous sequential casting of metals wherein a mold is advanced to a position directly under an outlet of a rotating furnace and then synchronized to move in arcuate motion with the outlet during the filling of the mold comprising: a furnace mounted for rotation about a vertical axis having a centrally disposed main chamber and a pair of outlet chambers extending outwardly from said main chamber, the inner end portions of the outlet chambers communicating interiorly with the lower portion of the main chamber, such that, a continuous circuit of molten metal is provided between said chambers and slag in the main chamber is prevented from entering the outlet chambers, an outlet in each of the outer end portions of the outlet chambers for discharging metal from the furnace, said outlets traversing an arcuate path during the discharge of metal therefrom and in continuous contact with the molten metal during the operation of the furnace and closure means for opening and closing the outlets; a series of molds for receiving the discharge of metal directly from said outlets; means for rotating the furnace about said vertical axis; means for transporting the molds consecutively to and from said furnace, such that, when a pair of molds are advanced to a position under the furnace outlets, said molds move in an arcuate path under said outlets during the discharge of metal from said outlets; and means for controlling the operation of said furnace whereby the motion and discharge of said furnace is synchronized with the motions of said molds.

5. An apparatus for the continuous sequential casting of metals comprising: a foundation structure; a bearing means mounted on the foundation structure; a platform structure supportably mounted on the bearing means for rotation about a vertical axis passing through the foundation structure; a first driving means mounted to the foundation structure and connected to the platform structure for rotating the platform structure about said vertical axis; a journal means attached to one end portion of the platform structure with the axis of the journal means being horizontally disposed; a base plate supportably mounted on the platform structure and connected to an end portion thereof to the journal means; a second driving means mounted to the platform structure and connected to the base plate for rotating the base plate about said horizontal axis; a furnace supportably mounted on the base plate having a cylindrical chamber centered about said vertical axis for receiving and holding a metallic type charge, an annular opening in the top portion thereof which is concentric about said vertical axis, at least one outlet chamber extending outwardly from a lower portion of said central chamber with an outlet at the outer end portion thereof for discharging metal from the furnace and a means for opening and closing said outlet; a series of molds for receiving metal from said furnace; means for transporting the molds consecutively to and from said furnace and moving said molds in arcuate motion directly below said discharge outlet during the filling of said molds; and a control means whereby the motion of said outlet and discharge of said outlet are synchronized with the motion of said molds during the filling thereof.

6. The apparatus for the continuous sequential casting of metals as recited in claim 1 wherein said bearing means is a plurality of rollers spaced apart in a circular arrangement around the outer portion of said foundation structure and adapted for supportably guiding said platform structure.

7. The apparatus for the continuous sequential casting of metals as recited in claim 1 wherein said first and second driving means are hydraulic cylinders.

8. The apparatus for the continuous sequential casting of metals as recited in claim 5 wherein said first and second driving means are pneumatic cylinders.

9. The apparatus for the continuous sequential casting of metals as recited in claim 2 wherein said first driving means comprises a gear drive unit connected to said platform structure in combination with a speed reducing means and electric motor.

10. The apparatus for the continuous sequential casting of metals as recited in claim 5 wherein said furnace has a pair of outlets for discharging metal therefrom.

* * * * *